US011495395B2

(12) United States Patent
Song et al.

(10) Patent No.: US 11,495,395 B2
(45) Date of Patent: Nov. 8, 2022

(54) INDUCTOR

(71) Applicant: SAMSUNG ELECTRO-MECHANICS CO., LTD., Suwon-si (KR)

(72) Inventors: Sung Min Song, Suwon-si (KR); Hwan Soo Lee, Suwon-si (KR); Yoon Hee Cho, Suwon-si (KR); Yong Choon Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 381 days.

(21) Appl. No.: 16/179,575

(22) Filed: Nov. 2, 2018

(65) Prior Publication Data

US 2019/0333688 A1 Oct. 31, 2019

(30) Foreign Application Priority Data

Apr. 25, 2018 (KR) ..... 10-2018-0047654

(51) Int. Cl.

| | |
|---|---|
| ***H01F 5/00*** | (2006.01) |
| ***H01F 27/29*** | (2006.01) |
| ***H01F 17/00*** | (2006.01) |
| ***H01F 27/32*** | (2006.01) |
| ***H01F 27/28*** | (2006.01) |
| *H01F 41/04* | (2006.01) |
| *H01F 41/12* | (2006.01) |

(52) U.S. Cl.

CPC ..... *H01F 27/292* (2013.01); *H01F 17/0013* (2013.01); *H01F 27/2804* (2013.01); *H01F 27/327* (2013.01); *H01F 41/042* (2013.01); *H01F 41/125* (2013.01); *H01F 2027/2809* (2013.01)

(58) Field of Classification Search

USPC ..... 336/200

See application file for complete search history.

(56) References Cited

U.S. PATENT DOCUMENTS 5,750,264 A * 5/1998 Ueno ..... H01C 1/142 428/688
5,976,679 A 11/1999 Tomono et al.
7,054,136 B2 * 5/2006 Ritter ..... H01G 4/2325 361/312

(Continued)

FOREIGN PATENT DOCUMENTS

JP H09-214209 A 8/1997
JP H11-204337 A 7/1999

(Continued)

*Primary Examiner* — Ronald Hinson

(74) *Attorney, Agent, or Firm* — Morgan, Lewis & Bockius LLP

(57) ABSTRACT

An inductor includes a body including a support member including a through-hole, an internal coil disposed on the support member, and an encapsulant encapsulating the support member and the internal coil; and an external electrode disposed on an external surface of the body and connected to the internal coil. The external electrode includes a conductive resin layer and a double conductive layer of a first conductive layer and a second conductive layer, disposed between the conductive resin layer and the internal coil.

20 Claims, 4 Drawing Sheets

(56) References Cited

U.S. PATENT DOCUMENTS

| | | | | |
|---|---|---|---|---|
| 2007/0242416 | A1* | 10/2007 | Saito | H01G 4/2325 361/321.1 |
| 2008/0225462 | A1* | 9/2008 | Motoki | H01G 4/2325 361/306.3 |
| 2013/0076203 | A1* | 3/2013 | Saito | H05K 1/0306 310/311 |
| 2014/0319974 | A1* | 10/2014 | Feichtinger | H01C 7/18 310/365 |
| 2016/0042857 | A1* | 2/2016 | Chun | H01F 27/292 336/200 |
| 2018/0096783 | A1* | 4/2018 | Fukuda | H01F 27/346 |

FOREIGN PATENT DOCUMENTS

| | | | |
|---|---|---|---|
| KR | 10-2016-0019266 | A | 2/2016 |
| KR | 10-1876878 | B1 | 7/2018 |

* cited by examiner

INDUCTOR

CROSS-REFERENCE TO RELATED APPLICATION(S)

This application claims the benefit of priority to Korean Patent Application No. 10-2018-0047654 filed on Apr. 25, 2018 in the Korean Intellectual Property Office, the disclosure of which is incorporated herein by reference in its entirety.

BACKGROUND

1. Field

The present disclosure relates to an inductor, and more particularly, to a power inductor.

2. Description of Related Art

An inductor, which is a type of coil electronic component, is a representative passive element constituting an electronic circuit, together with a resistor and a capacitor, to remove noise. The inductor is combined with the capacitor using electromagnetic properties to constitute a resonance circuit amplifying a signal in a specific frequency band, a filter circuit, or the like.

In recent years, metal-based power inductors using amorphous metal or crystalline metal materials have been widely applied to mobile devices due to their excellent DC bias characteristics and power conversion efficiency characteristics. In the future, it is expected that metal-based power inductors will also be gradually expanded in the industrial and electrical device fields, and thus a power inductor having a high level of reliability is required.

SUMMARY

An aspect of the present disclosure may provide an inductor having improved product reliability by enforcing bonding properties of external electrodes.

According to an aspect of the present disclosure, an inductor includes a body including a support member including a through-hole, an internal coil disposed on the support member, and an encapsulant encapsulating the support member and the internal coil; and an external electrode disposed on an external surface of the body and connected to the internal coil. The external electrode includes a conductive resin layer and a double conductive layer of a first conductive layer and a second conductive layer, disposed between the conductive resin layer and the internal coil.

The conductive resin layer may include a resin and metal particles dispersed in the resin.

The conductive resin layer may be a silver (Ag)-epoxy resin layer.

The first conductive layer may be in direct contact with the internal coil and may be made of a single metal or an alloy.

The first conductive layer and the internal coil may be made of the same material.

The first conductive layer may contain copper (Cu).

The second conductive layer covering a surface of the first conductive layer among the first and second conductive layers may be in contact with the conductive resin layer.

The second conductive layer may extend to one or more of an upper surface and a lower surface of the body from the surface of the first conductive layer.

The second conductive layer may be disposed on corners surrounded by the conductive resin layer.

The second conductive layer may contain nickel (Ni).

The second conductive layer may contain a noble metal.

The second conductive layer may include a first layer and a second layer.

The first and second layers may be a nickel layer and a noble metal layer.

An end portion of the support member exposed to the outside of the body may be indirect contact with the conductive resin layer.

Each of both end portions of the support member, in contact with the external electrodes, may include a penetrating portion.

The penetrating portion may be filled with a lead out portion of the internal coil.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
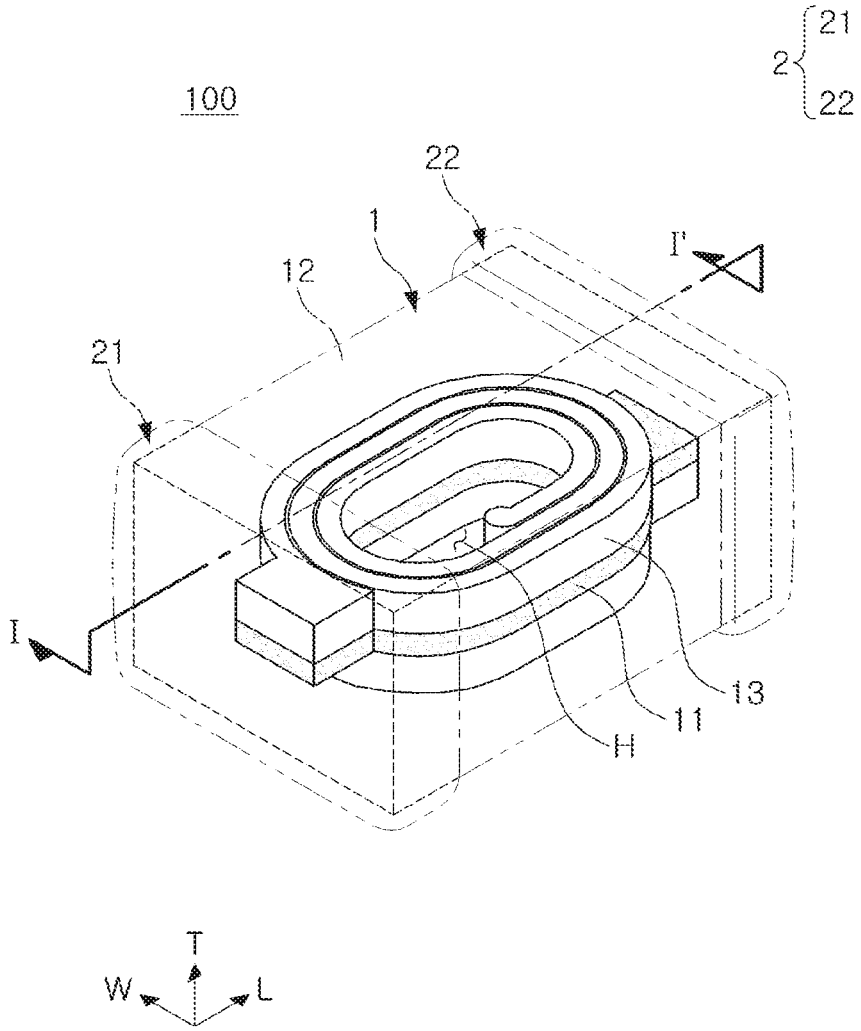
FIG. 1 is a schematic perspective view illustrating an inductor according to an exemplary embodiment in the present disclosure.
Figure 2:
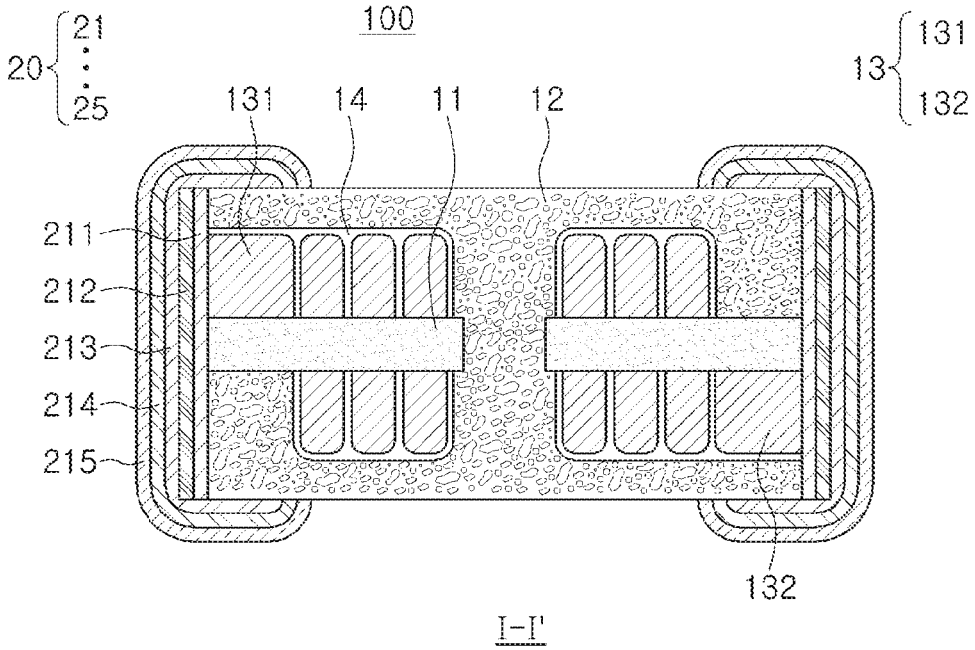
FIG. 2 is a cross-sectional view taken along a line I-I' of FIG. 1.

FIG. 1 is a schematic perspective view illustrating an inductor according to an exemplary embodiment in the present disclosure, and FIG. 2 is a cross-sectional view taken along a line I-I' of FIG. 1.

Referring to FIGS. 1 and 2, an inductor 100 according to the present disclosure may include a body 1 and an external electrode 2 disposed on an external surface of the body.

The body 1 may determine an outer shape of the inductor, and have a hexahedral shape including a first end surface and a second end surface opposing each other in a length (L) direction, a first side surface and a second side surface opposing each other in a width (W) direction, and an upper surface and a lower surface opposing each other in a thickness (T) direction.

The body 1 may include a support member 11 including a through-hole H in a central portion thereof. The support member may serve to easily form an internal coil and to support the internal coil. The support member may be formed of a thin plate having insulation property, and may be formed of, for example, a thermosetting resin such as an epoxy resin, a thermoplastic resin such as polyimide, or a resin having a reinforcement material such as a glass fiber or an inorganic filler impregnated in the thermosetting resin and the thermoplastic resin. Specifically, a known copper clad lamination (CCL) substrate, an Ajinomoto Build-up Film (ABF) film, FR-4, a Bismaleimide Triazine (BT) resin, a PID resin, or the like may be used.

The support member may be encapsulated by an encapsulant 12, and the encapsulant 12 may also fill the through-hole of the support member. The encapsulant 12 may have a magnetic property and may include a magnetic material and a resin. The magnetic material may be applied without limitation as long as it has the magnetic property, and may be, for example, a ferrite or a metal magnetic particle. The metal magnetic particle may specifically include iron (Fe), chromium (Cr), aluminum (Al), or nickel (Ni), but is not limited thereto.

The support member may have a function of supporting an internal coil 13, and the internal coil may be supported by the support member and have entirely a spiral shape. The internal coil 13 may include a first end portion 131 connected to a first external electrode 21 and a second end portion 132 connected to a second external electrode 22.

A surface of the internal coil 13 may be coated with an insulating layer 14, such that the internal coil may be insulated from the magnetic material in the encapsulant. A method for forming the insulating layer 14 is not limited. For example, a chemical vapor deposition method or a method for stacking insulating sheets may be used, but the method for forming the insulating layer 14 is not limited thereto.

Each of the first and second external electrodes 21 and 22 connected to both end portions 131 and 132 of the internal coil, respectively, may include a plurality of layers.

Since a description of the first external electrode 21 may be applied to the second external electrode 22 as it is, the description of the first external electrode replaces the description of the second external electrode.

Referring to FIG. 2, the first external electrode 21 may include a first conductive layer 211 which is directly connected to the first end portion 131 of the internal coil. The first conductive layer may be made of the same material as the material forming the internal coil. For example, both the first conductive layer and the internal coil may be copper (Cu) plating layers. In this case, the Cu plating layer may be a single metal, but may also be an alloy to which a conductive material such as tin (Sn), nickel (Ni), or the like is added. Since the first conductive layer may be directly connected to the first end portion of the internal coil and include the same material as that of the first end portion, the first conductive layer may have a function of expanding the first end portion of the internal coil. In other words, in a case in which a contact area that the first end portion of the internal coil is in contact with the first external electrode is narrow, a contact failure between the internal coil and the external electrode may be caused and a contact resistance may be increased. In order to solve the above-mentioned problems, the contact area between the first end portion and the first external electrode may be increased by expanding the first end portion of the internal coil.

Next, a second conductive layer 212 may be disposed on the first conductive layer 211. The second conductive layer 212 may be a layer for preventing diffusion of tin (Sn) in a solder applied when the inductor is mounted on a substrate, or Sn included in another layer of the first external electrode disposed outside of the second conductive layer toward the internal coil. In a case in which the inductor 100 is exposed to a severe environment of high temperature (approximately 150° C. or more) or high temperature and high humidity, the diffusion of Sn included in the inductor or an external material (for example, a solder) may be accelerated. In the case in which the diffusion of Sn is accelerated, Sn may permeate into the internal coil or the first conductive layer expanding the end portion of the internal coil, thereby promoting deterioration of the inductor. However, the second conductive layer may serve to prevent Sn from diffusing into the internal coil or the first conductive layer extending the end portion of the internal coil. The second conductive layer may be a nickel (Ni) layer and may be a thin film layer including a noble metal having low reactivity. In particular, when the second conductive layer 212 is made of Ni, it may be effective when one layer of the external electrodes including the plurality of layers is a conductive resin layer 213 as described below.

The conductive resin layer 213 may be a layer including a resin and metal particles dispersed in the resin, and may be a silver (Ag)-epoxy resin layer. In this case, when the second conductive layer including nickel (Ni) is interposed between the conductive resin layer and the first conductive layer, one or more of the permeating Sn component, the Ni component of the second conductive layer, the Ag component in the conductive resin layer, and the Cu component of the coil may form an intermetallic compound (IMC) to thereby effectively prevent Sn from permeating an interface of the internal coil to deteriorate the inductor.

Next, a nickel (Ni) layer 214 and a tin (Sn) layer (215) may be sequentially disposed on the conductive resin layer 213. The Ni layer 214 may mainly serve to improve conductivity of the first external electrode together with the conductive resin layer, and the Sn layer 215 may mainly serve to improve bonding properties with the soldering when the inductor is mounted on the substrate. The nickel layer 214 may extend beyond the conductive resin layer 213 on the upper surface and the lower surface of the body, and the tin layer 215 may extend beyond the nickel layer 214 on the upper surface and the lower surface of the body.

The first external electrode 21 sequentially includes the first and second conductive layers, the conductive resin layer, the Ni layer, and the Sn layer, such that deterioration of characteristics due to diffusion of Sn in a high temperature load environment may be effectively prevented.

Figure 3:
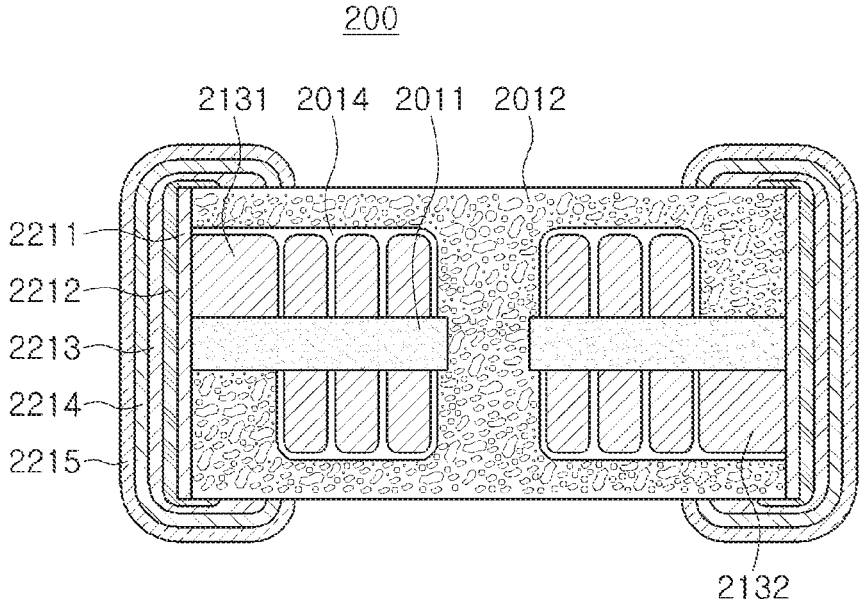
FIG. 3 is a cross-sectional view of an inductor according to a first modified example of the inductor illustrated in FIGS. 1 and 2.

FIG. 3 is a cross-sectional view of an inductor 200 according to a modified example of the inductor 100 illustrated in FIGS. 1 and 2. The inductor 200 illustrated in FIG. 3 is different from the inductor 100 illustrated in FIGS. 1 and 2 only in a structure of a second conductive layer 2212, and may have the same structure of the inductor as that of the inductor 100. Therefore, for convenience of explanation, an overlapped description will be omitted, and reference numerals of corresponding components are represented by adding "2" or "20" to the reference numerals used in FIGS. 1 and 2. Meanwhile, FIGS. 4 through 6 to be described below will be described in the same manner.

Referring to FIG. 3, the second conductive layer 2212 may extend by a predetermined length along the upper surface and the lower surface of the body. In this case, the second conductive layer may extend to surround corners surrounded by a conductive resin layer 2213 on the second conductive layer among corners forming the upper surface and the lower surface of the body. The conductive resin layer 2213 may extend beyond the second conductive layer 2212 on the upper surface and the lower surface of the body.

On characteristics of a process of forming the conductive resin layer, the conductive resin layer may be thinly coated at the corner portions surrounded by the conductive resin layer. For this reason, a deterioration phenomenon due to the diffusion of Sn in the corner portions may be particularly problematic.

In the inductor 200 of FIG. 3, the diffusion of Sn through the corner portions at which the conductive resin layer is thinly coated may be more reliably blocked by extending the second conductive layer preventing the diffusion of Sn up to the corner portions.

Figure 4:
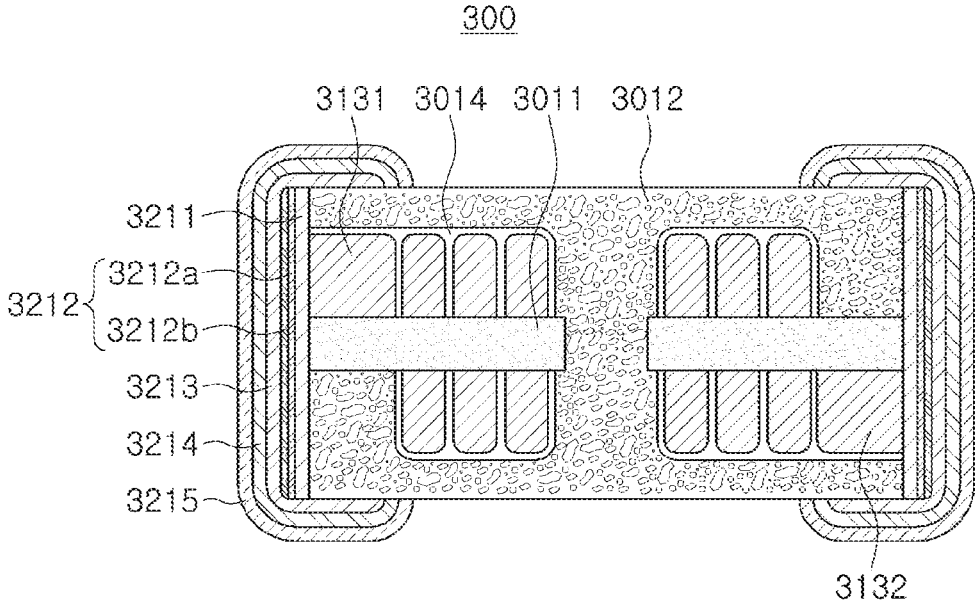
FIG. 4 is a cross-sectional view of an inductor according to a second modified example of the inductor illustrated in FIGS. 1 and 2.

FIG. 4 is a cross-sectional view of an inductor 300 according to a modified example of the inductor 100 illustrated in FIGS. 1 and 2.

Referring to FIG. 4, a second conductive layer 3212 may be formed in a double layer and have a structure in which a first layer 3212*a* close to the first conductive layer and a second layer 3212*b* close to the conductive resin layer are combined with each other. The first layer may be a nickel (Ni) layer and the second layer may be a layer including a noble metal, and vice-versa.

By forming the second conductive layer in the double layer, the diffusion of the Sn component toward the internal coil may be more reliably prevented.

Figure 5:
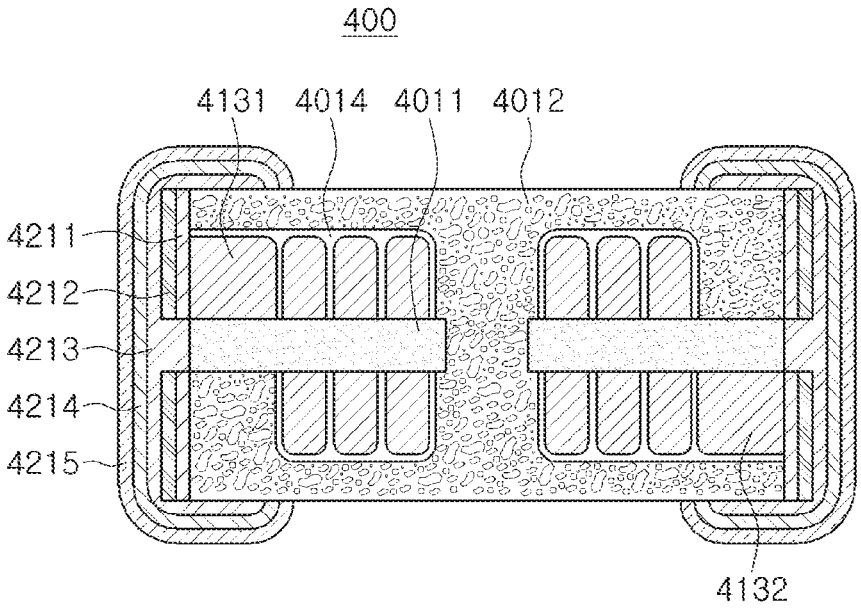
FIG. 5 is a cross-sectional view of an inductor according to a third modified example of the inductor illustrated in FIGS. 1 and 2.

FIG. 5 is a cross-sectional view of an inductor 400 according to another modified example of the inductor 100 illustrated in FIGS. 1 and 2.

Referring to FIG. 5, both end portions of a support member 4011 may not be in contact with the first conductive layer and may be in direct contact with a conductive resin layer 4213. The support member and the conductive resin layer including the resin component as a common material are in direct contact with each other, so that bonding force between the external electrode and the body may be further strengthened as compared with a case in which the support member and the first conductive layer are directly bonded.

Figure 6:
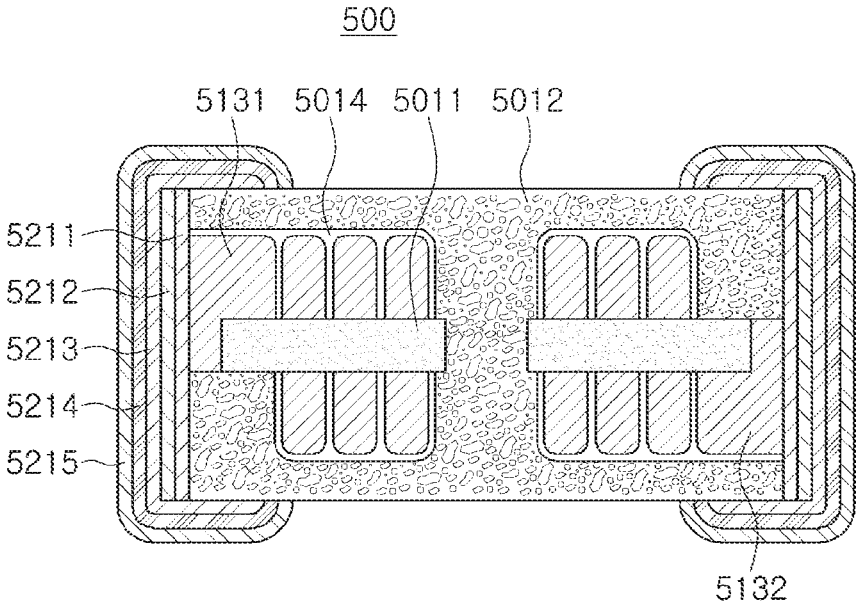
FIG. 6 is a cross-sectional view of an inductor according to a fourth modified example of the inductor illustrated in FIGS. 1 and 2.

FIG. 6 is a cross-sectional view of an inductor 500 according to another modified example of the inductor 100 illustrated in FIGS. 1 and 2.

Referring to FIG. 6, a support member 5011 may include penetrating portions h1 and h2 in both end portions thereof, and the penetrating portions h1 and h2 may be filled by both end portions 5131 and 5132 of the internal coil. The internal coil extends to a side surface of the support member, such that a contact area between the end portion of the internal coil and the first conductive layer may be further increased. As a result, contact reliability between the external electrode and the internal coil may be increased, and contact resistance therebetween may be decreased.

When the external electrode including the plurality of layers include the conductive resin layer, a tin (Sn) component in an Sn layer formed outside of the conductive resin layer or an Sn component contained in a solder applied to mount the inductor on the substrate is diffused toward the internal coil from the conductive resin layer, which results in a problem in which connectivity between the external electrode and the internal coil is deteriorated. Such a problem is particularly intensified when the inductor is exposed to a high temperature and high humidity environment. According to a structure of the external electrode of the inductor according to the present disclosure described above, even though the inductor is particularly exposed to the high temperature and high humidity environment, since the deterioration due to the diffusion of the Sn component may be prevented, the inductor that may be utilized as an electronic component for electrical device may be provided.

As set forth above, according to an exemplary embodiment in the present disclosure, in the inductor having the external electrode including the conductive resin layers, the problem in which the Sn component included in the outside of the conductive resin layer, for example, the solder for bonding the external electrode to an external component, or the Sn component included in the Sn layer formed at the outermost side of the external electrode permeates into the conductive resin layer to thereby deteriorate the bonding properties between the external electrode and the internal coil may be solved.

While exemplary embodiments have been shown and described above, it will be apparent to those skilled in the art that modifications and variations could be made without departing from the scope of the present invention as defined by the appended claims.

What is claimed is:

1. An inductor comprising:

a body including a support member including a through-hole, an internal coil disposed on the support member, and an encapsulant encapsulating the support member and the internal coil; and an external electrode disposed on an external surface of the body and connected to the internal coil, wherein the external electrode includes a conductive resin layer and a double conductive layer of a first conductive layer and a second conductive layer, disposed between the conductive resin layer and the internal coil, wherein the first conductive layer is disposed on a side surface of the body without extending onto at least one of an upper or lower surface of the body, wherein the second conductive layer includes a first portion disposed on the side surface and a second portion having a reduced-thickness which extends from the first portion onto the upper and lower surfaces, and wherein the conductive resin layer is disposed on the second portion.

2. The inductor of claim 1, wherein the conductive resin layer includes a resin and metal particles dispersed in the resin.

3. The inductor of claim 1, wherein the conductive resin layer is a silver (Ag)-epoxy resin layer.

4. The inductor of claim 1, wherein an end portion of the support member exposed to the outside of the body is in indirect contact with the conductive resin layer.

5. The inductor of claim 1, wherein the first conductive layer is in direct contact with the internal coil and is made of a single metal or an alloy.

6. The inductor of claim 5, wherein the first conductive layer and the internal coil are made of the same material.

7. The inductor of claim 5, wherein the first conductive layer contains copper (Cu).

8. The inductor of claim 1, wherein each of both end portions of the support member in contact with the external electrode includes a penetrating portion.

9. The inductor of claim 8, wherein the penetrating portion is filled with a lead out portion of the internal coil.

10. The inductor of claim 1, further comprising a nickel layer disposed on the conductive resin layer and a tin layer disposed on the nickel layer.

11. The inductor of claim 10, wherein the nickel layer extends beyond the conductive resin layer on the upper surface and the lower surface of the body, and the tin layer extends beyond the nickel layer on the upper surface and the lower surface of the body.

12. The inductor of claim 1, wherein the second conductive layer covers a surface of the first conductive layer and is in contact with the conductive resin layer.

13. The inductor of claim 12, wherein the second conductive layer is disposed on corners surrounded by the conductive resin layer.

14. The inductor of claim 12, wherein the second conductive layer contains nickel (Ni).

15. The inductor of claim 12, wherein the second conductive layer contains a noble metal.

16. The inductor of claim 12, further comprising an insulating layer disposed on a surface of the internal coil, in contact with the first conductive layer, and arranged between the internal coil and encapsulant.

17. The inductor of claim 16, wherein the conductive resin layer extends beyond the second conductive layer on the upper surface and the lower surface of the body.

18. The inductor of claim 17, further comprising a nickel layer disposed on the conductive resin layer and a tin layer disposed on the nickel layer, wherein the nickel layer extends beyond the conductive resin layer on the upper surface and the lower surface of the body, and the tin layer extends beyond the nickel layer on the upper surface and the lower surface of the body.

19. The inductor of claim 12, wherein the second conductive layer includes a first layer and a second layer.

20. The inductor of claim 19, wherein the first layer is a nickel layer and the second layer is a noble metal layer.

* * * * *